US007524019B2

(12) United States Patent
Fukasawa et al.

(10) Patent No.: US 7,524,019 B2
(45) Date of Patent: Apr. 28, 2009

(54) METHOD FOR CLEANING LIQUID EJECTION APPARATUS AND LIQUID EJECTION APPARATUS

(75) Inventors: Shigenori Fukasawa, Nagano-ken (JP); Hitoshi Hayakawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 405 days.

(21) Appl. No.: 11/377,369

(22) Filed: Mar. 17, 2006

(65) Prior Publication Data

US 2006/0214981 A1 Sep. 28, 2006

(30) Foreign Application Priority Data

Mar. 17, 2005 (JP) ..... 2005-077491
Nov. 10, 2005 (JP) ..... 2005-326447
Feb. 8, 2006 (JP) ..... 2006-031571

(51) Int. Cl.
*B41J 2/165* (2006.01)
*B41J 2/215* (2006.01)

(52) U.S. Cl. ..... 347/36; 347/34; 347/35; 347/83

(58) Field of Classification Search ..... 347/22, 347/29, 30, 32, 34, 35, 36, 83
See application file for complete search history.

(56) References Cited

U.S. PATENT DOCUMENTS 6,203,137 B1 * 3/2001 Niimura et al. ..... 347/36
6,561,621 B2 * 5/2003 Webster et al. ..... 347/34
6,832,829 B2 * 12/2004 Droege et al. ..... 347/83
2001/0038400 A1 11/2001 Yamada et al.
2003/0151638 A1 8/2003 Williamson

FOREIGN PATENT DOCUMENTS

EP 0 358 487 A 3/1990
EP 1 162 072 A 12/2001
JP 4-28560 * 1/1992
JP 2004-167945 A 6/2004
JP 2004-174766 A 6/2004

OTHER PUBLICATIONS

European Search Report Aug. 23, 2006.

* cited by examiner

*Primary Examiner*—Shih-wen Hsieh
(74) *Attorney, Agent, or Firm*—Sughrue Mion, PLLC

(57) ABSTRACT

A printer includes a recording head having a nozzle through which ink is ejected onto a paper sheet and a waste tank in which the ink is retained as waste liquid after having been drained from the recording head. A deposit of the waste liquid is formed in the waste tank. The printer has a suction pump used for forcibly drawing and draining the ink from the nozzle. The suction pump functions also as a gas blasting device that blasts gas to the deposit in the waste tank for blowing off the deposit. This suppresses the amount of the ink consumed in maintenance of the printer.

17 Claims, 11 Drawing Sheets

METHOD FOR CLEANING LIQUID EJECTION APPARATUS AND LIQUID EJECTION APPARATUS

CROSS-REFERENCE TO RELATED APPLICATIONS

This application is based upon and claims the benefit of priority from prior Japanese Patent Applications No. 2005-077491 filed on Mar. 17, 2005, No. 2005-326447 filed on Nov. 10, 2005, No. 2006-031571 filed on Feb. 8, 2006, the entire contents of which are incorporated herein by reference.

BACKGROUND OF THE INVENTION

The present invention relates to methods for cleaning liquid ejection apparatuses that eject liquid droplets through a liquid ejection head, including inkjet recording apparatuses, display manufacturing apparatuses, electrode manufacturing apparatuses, and biochip manufacturing apparatuses, and such liquid ejection apparatuses.

As a typical liquid ejection apparatus that ejects liquid onto a target, an inkjet printer is known. The inkjet printer ejects ink droplets onto a sheet of paper and thus prints an image on the paper sheet. The printer includes a plurality of nozzles that are defined in a recording head for ejecting ink. Each of the nozzles is normally filled with ink to be ejected.

When the inkjet printer is maintained in a standby state, solvent of the ink may evaporate from the nozzles, thus increasing viscosity of the ink or solidifying the ink. Also, in this state, dust may clog the nozzles. Further, air may enter the nozzles through the openings of the nozzles and thus produce bubbles in the nozzles. This may cause a printing failure such as missing dots. In order to solve these problems, the inkjet printer includes a cap and a suction pump connected to the cap. The cap seals a nozzle surface of the recording head and the suction pump generates negative pressure in the cap. The suction pump is activated when the inkjet printer is held in a non-printing state. This forcibly discharges the ink with the increased viscosity or the solidified ink from the nozzles into a waste tank, thus cleaning the nozzles. However, a flow of the ink caused by such cleaning may contain usable ink, which is discarded together with the unusable ink.

Since ink having a prolonged life and an improved brightness is desirable, pigment ink, which has a longer life and a greater brightness than dye ink, is often used. However, the pigment ink contains pigment particles that are dispersed in ink solvent, which increases volatility of the ink compared to the dye ink. The pigment ink thus solidifies more easily than the dye ink.

Therefore, if the aforementioned cleaning is performed on the pigment ink, the discharged pigment ink (that contains usable pigment ink) may solidify in the waste tank. The solidified ink gradually forms a deposit on a corresponding portion of the waste tank as the nozzle cleaning is repeatedly carried out. This may cause a problem such as a blockage of a suction tube, which is connected to the suction pump and drains the discharged ink into the waste tank, at a discharge port of the suction tube communicating with the waste tank.

Japanese Laid-Open Patent Publication No. 2004-174766 discloses a configuration in which a deposit of waste ink, which is formed in a waste tank, is dissolved by additional ink that is forcibly introduced into the waste tank after having been drawn by a suction pump.

Japanese Laid-Open Patent Publication No. 2004-167945 discloses a configuration in which a deposit of waste ink is removed by a removal device including a gear and a removal late or a belt conveyor.

However, since the ink deposit is removed by the additional ink in the technique disclosed No. 2004-174766, the ink consumption is increased correspondingly and the cost is raised. If the removal device is incorporated in the waste tank as described in No. 2004-167945, the waste tank must be enlarged for ensuring room for the removal device, complicating the configuration.

These problems may occur also with different types of liquid ejection apparatuses, which eject liquid droplets through a liquid ejection head, other than the inkjet printers. Such apparatuses include the display manufacturing apparatuses, the electrode manufacturing apparatuses, and the biochip manufacturing apparatuses.

SUMMARY OF THE INVENTION

Accordingly, it is an objective of the present invention to provide a method for cleaning a liquid ejection apparatus and a liquid ejection apparatus that saves costs and prevents enlargement of a waste tank.

To achieve the foregoing objective, one aspect of the present invention provides a method for cleaning a liquid ejection apparatus. The apparatus includes a liquid ejection head that has a nozzle through which a liquid is ejected onto a target and a waste tank that retains the liquid discharged from the liquid ejection head as a waste liquid. A deposit of the waste liquid is formed in the waste tank. The method includes blowing off the deposit by blasting gas to the deposit in the waste tank through actuation of a gas blasting device.

Another aspect of the present invention provides a liquid ejection apparatus including a liquid ejection head having a nozzle through which a liquid is ejected onto a target, and a waste tank in which the liquid is retained as a waste liquid after having been discharged from the liquid ejection head. A deposit of the waste liquid is formed in the waste tank. The apparatus includes a gas blasting device that blows off the deposit by blasting gas to the deposit in the waste tank.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 8.

Figure 1:
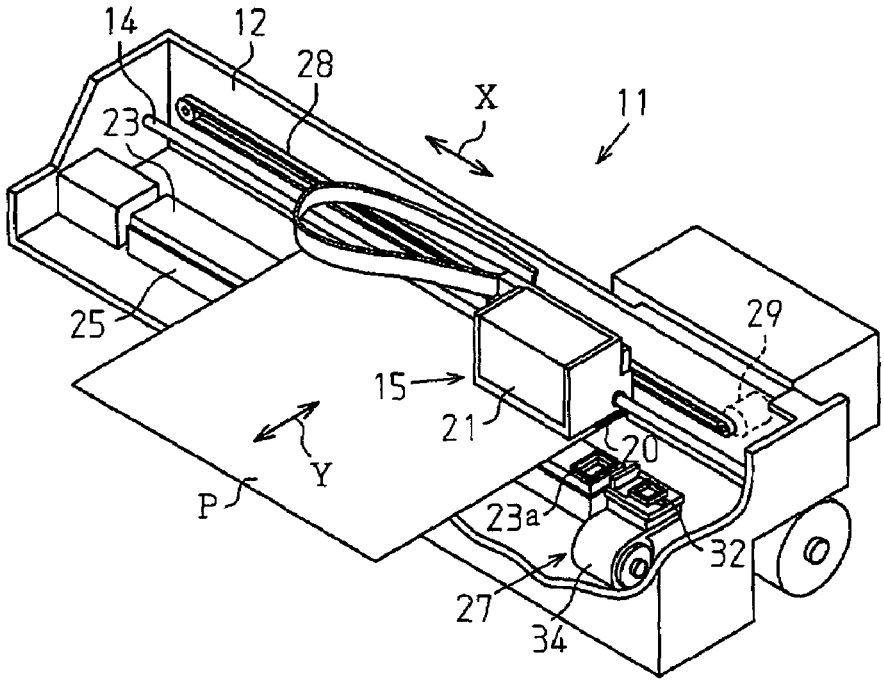
FIG. 1 is a perspective view showing a printer according to a first embodiment of the present invention.
Figure 2:
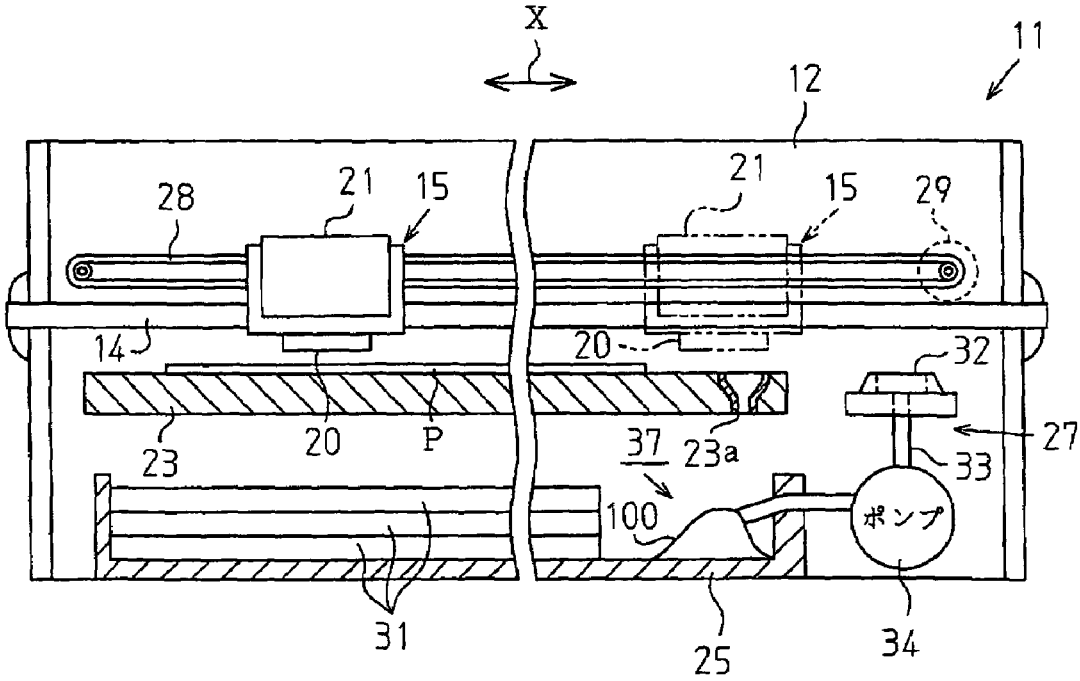
FIG. 2 is a front cross-sectional view showing the printer of FIG. 1.

As shown in FIGS. 1 and 2, a printer 11, which is a liquid ejection apparatus according to the first embodiment, includes a frame 12, a guide member 14, a carriage 15, a recording head 20 serving as a liquid ejection head, an ink cartridge 21, a platen 23, a waste tank 25, and a head cleaning mechanism 27.

The frame 12 accommodates the printer 11 as a whole. The guide member 14 is supported by the frame 12 in a suspended state and extends in the longitudinal direction of the frame 12. The guide member 14 is passed through the carriage 15 in such a manner that the carriage 15 is movable along the guide member 14. The carriage 15 is connected to a carriage motor 29 through a timing belt 28. The carriage 15 is thus reciprocated along the guide member 14, or in a main scanning direction X, through operation of the carriage motor 29.

Figure 4:
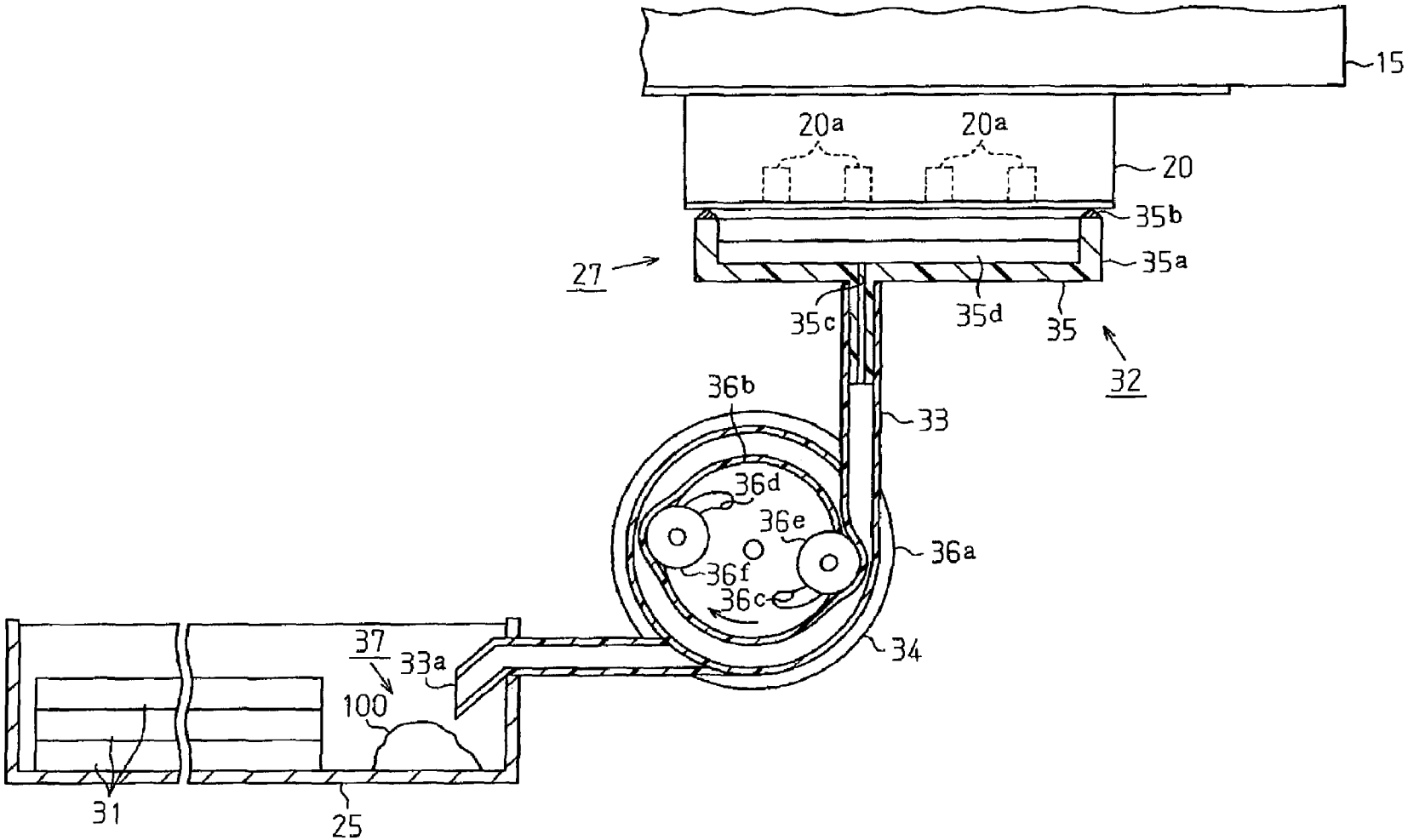
FIG. 4 is a diagrammatic cross-sectional view showing a cleaning mechanism.

The recording head 20 is formed in a lower portion of the carriage 15. As shown in FIG. 4, a plurality of nozzles 20*a* (only four of them are shown in the drawing) are defined in a lower surface (hereinafter, referred to also as a "nozzle surface") of the recording head 20. The ink cartridge 21 is provided in an upper portion of the carriage 15. The ink cartridge 21 is caused to supply ink, or liquid, to the recording head 20 through excitement of a piezoelectric element (not shown) incorporated in the recording head 20. Ink droplets are thus ejected from the nozzles 20*a*.

The platen 23 serves as a support table that supports a paper sheet P as a target. The platen 23 is supported by the frame 12 in a suspended state and extends parallel with the guide member 14. The platen 23 opposes the recording head 20. As viewed in FIG. 2, a through hole 23*a* extends vertically through a right end of the platen 23. A non-illustrated paper feeder mechanism feeds the paper sheet P along the platen 23 in a sub scanning direction Y (see FIG. 1), which extends perpendicular to the main scanning direction X. The paper sheet P thus opposes the recording head 20 when supported by the platen 23.

The recording head 20 is reciprocated along the guide member 14 in a range opposed to the paper sheet P. Meanwhile, the piezoelectric element is actuated in correspondence with printing data, causing ejection of the ink droplets from the recording head 20 onto the paper sheet P. Printing is thus performed on the paper sheet P.

As shown in FIG. 2, the waste tank 25 is shaped like a non-lidded box that has an upper opening. The size and the position of the upper opening are selected in such a manner that, when the platen 23 is projected downward, the opening corresponds to the entire projection of the platen 23. The waste tank 25 receives a plurality of waste liquid absorption materials 31, each of which is formed of a porous material such as pulp, in a stacked state.

Figure 3:
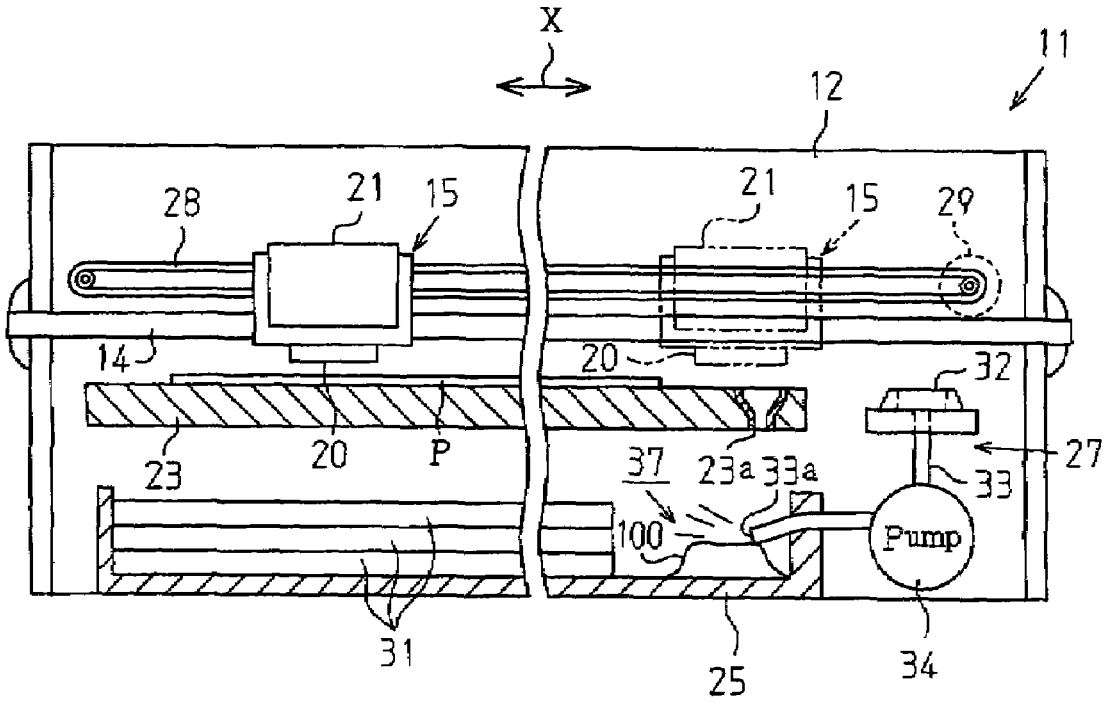
FIG. 3 is another front cross-sectional view showing the printer of FIG. 1.

A flushing liquid receiver section 37 is defined in a right end of the waste tank 25 as viewed in FIG. 2 and at a position opposed to the through hole 23*a* of the platen 23. When performing flushing, the recording head 20 is thus allowed to eject ink onto the flushing liquid receiver section 37 through the through hole 23*a* of the platen 23. When the recording head 20 is opposed to the through hole 23*a*, it is defined that the recording head 20 (the carriage 15) is located at a cap-open position. Referring to FIGS. 2 to 4, the flushing liquid receiver section 37 receives an end of a suction tube (a passage) 33 connected to a suction pump 34, which will be later described. This structure allows the suction pump 34 to discharge the ink into the flushing liquid receiver section 37 of the waste tank 25 as waste liquid. The flushing liquid receiver section 37 is arranged adjacent to the waste liquid absorption materials 31. The ink (the waste liquid) in the flushing liquid receiver section 37 is thus absorbed by the waste liquid absorption materials 31 from portions of the waste liquid absorption materials 31 that are held in contact with the ink.

The term "flushing" refers to ink ejection from the nozzles 20*a* of the printer 11 caused in response to a drive signal unrelated to printing, which is sent to the recording head 20.

Head Cleaning Mechanism 27

The head cleaning mechanism 27 will hereafter be explained with reference to FIG. 4.

The head cleaning mechanism 27 is provided at a right end of the printer 11 as viewed in FIG. 2, or in a non-printing area (at a home position). The head cleaning mechanism 27 includes a capping device 32, the suction tube 33, and the suction pump 34 serving as a gas blasting device. The suction tube 33 extends through the suction pump 34.

Figure 5:
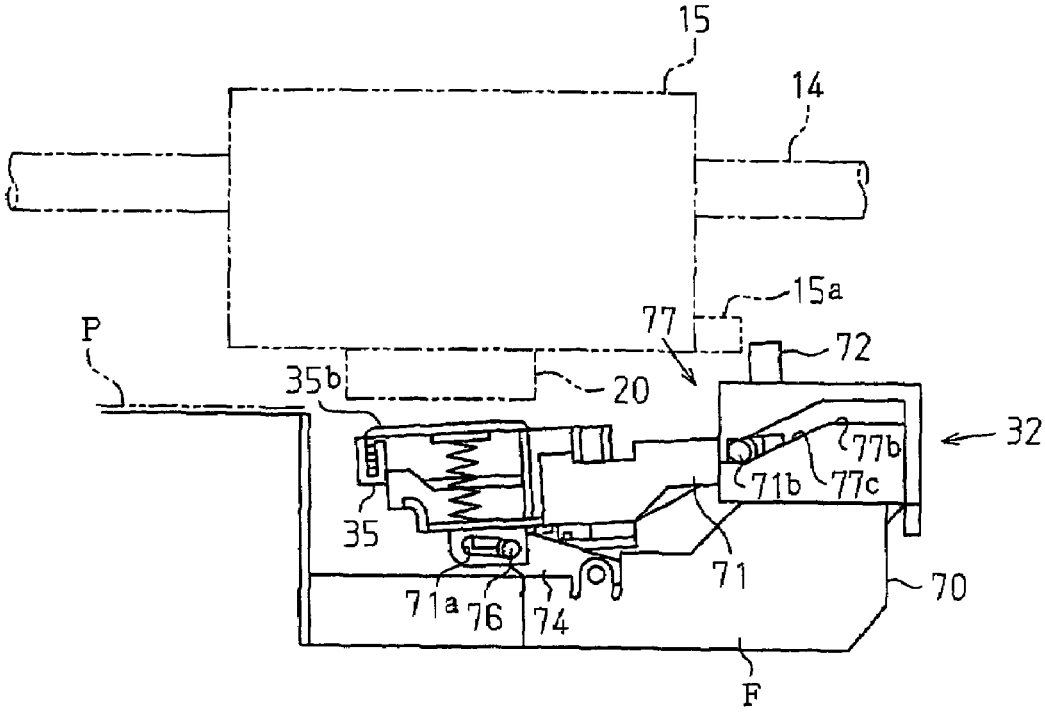
FIG. 5 is a side view showing a lift.
Figure 6:
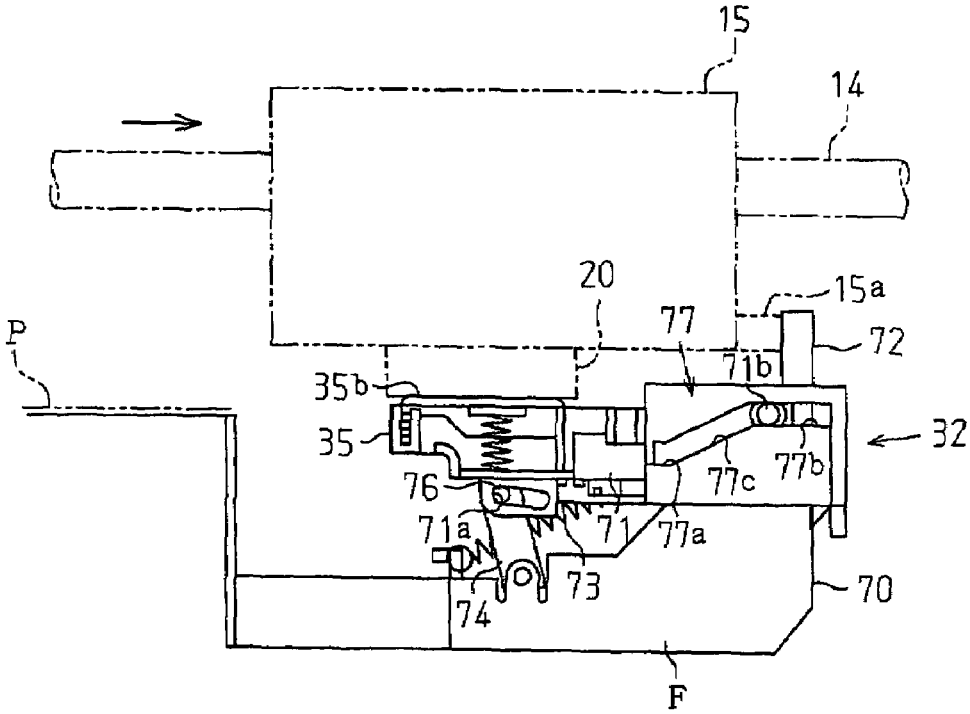
FIG. 6 is another side view showing the lift.

The capping device 32 includes a cap 35 and a lift 70 that selectively raises and lowers the cap 35 (see FIGS. 5 and 6).

The lift 70 will be explained in detail in the following.

As shown in FIGS. 5 and 6, the capping device 32 includes a frame F that slidably supports a slider 71. The slider 71 supports the cap 35. A pair of elongated bores 71*a*, which extend substantially horizontal, are defined in a lower portion of the slider 71 (only one of the elongated bores 71*a* is shown in the drawings). An arm 74 is pivotally secured to the frame F. A pair of horizontal shafts 76 are movably accommodated in the corresponding elongated bores 71*a*. Each of the horizontal shafts 76 is arranged at a free end of the arm 74. This structure allows the arm 74 to raise the slider 71 along an arcuate path with respect to the frame F. In other words, the slider 71 is allowed to selectively rise and lower in a state supported by the frame F.

A pair of guide pins 71*b* (only one is shown) are provided at opposing sides of an end (a right end as viewed in FIGS. 5 and 6) of the slider 71. A pair of guide grooves 77 (only one is shown) are defined in the frame F and receive the corresponding guide pins 71*b*. The guide pins 71*b* are thus supported by the guide grooves 77. Each of the guide grooves 77 includes a low section 77*a*, a high section 77*b*, and a slanted section 77*c* (see FIG. 6). The low section 77*a* is provided at an end portion of each guide groove 77. The high section 77*b* is formed at the opposing end portion of the guide groove 77 and extends horizontally. The slanted section 77*c* connects the low section 77*a* to the high section 77*b*.

An engagement portion 72 projects upward from the slider 71. A spring member 73 (see FIG. 6) extends between the slider 71 and the frame F. The engagement portion 72 engages an engagement portion 15*a* formed in the carriage 15 and moves rightward as viewed in FIG. 5. This diagonally raises the slider 71 rightward while supported by the horizontal shafts 76 as viewed in FIG. 6 against the elastic force generated by the spring member 73. After the engagement portion 72 of the slider 71 is disengaged from the engagement portion 15*a* of the carriage 15, the force restored by the spring member 73 acts to diagonally lower the slider 71 leftward while supported by the horizontal shafts 76, as viewed in FIG. 5. This structure allows the lift 70 to selectively raise and lower the cap 35.

More specifically, when the carriage 15 reaches the non-printing area of FIG. 6 (the home position), the cap 35 is raised by the lift 70 and held in contact with the lower surface (the nozzle surface) of the recording head 20 (the cap 35 is held in a sealing state). This seals the openings of the nozzles 20*a*. When cleaning the recording head 20 by drawing the ink from the nozzles 20*a*, the cap 35 seals the nozzle surface of the recording head 20. The suction pump 34, which is connected to the cap 35, thus produces negative pressure in the cap 35 and draws the ink from the recording head 20. The ink is then sent to the waste tank 25, which is provided in a lower section of the space defined by the frame 12. The term "cleaning" refers to forcible discharge of ink having an increased viscosity or solidified ink from the nozzles 20*a* of the recording head 20 into the waste tank 25. The term is also referred to as head cleaning or nozzle cleaning.

FIG. 4 is a diagrammatic view showing the cap 35 and the suction pump 34 with the lower surface (the nozzle surface) of the recording head 20 sealed by the cap 35.

The cap 35 has a cap holder 35*a* and a frame-like seal member 35*b* secured to an upper opening end of the cap holder 35*a*. The seal member 35*b* is formed of flexible material such as elastomer. An outlet port 35*c* extends through the bottom of the cap holder 35*a*. An end of the suction tube 33 is connected to the outlet port 35*c*. The opposing end of the suction tube 33 is connected to the waste tank 25. The suction pump 34 is thus arranged between the outlet port 35*c* and the waste tank 25. The suction tube 33 is formed of flexible material such as silicone rubber. The end of the suction tube 33 connected to the waste tank 25 will hereafter be referred to as a discharge port 33*a*.

When the cap 35 is raised by the lift 70 and the seal member 35*b* contacts the nozzle surface of the recording head 20, the space defined by the nozzle surface and the cap 35 becomes substantially sealed. By activating the suction pump 34 in this state, the gas (the air) and the ink can be drawn from this space and thus negative pressure is produced in the space. The negative pressure acts on the nozzles 20*a* so that the ink is discharged from the nozzles 20*a* through the outlet port 35*c*, which is defined in the bottom of the cap holder 35*a*.

The cap holder 35*a* accommodates a sheet-like ink absorption material 35*d*. The ink absorption material 35*d* receives the ink from the nozzles 20*a* and temporarily retains the ink. This maintains the humidity in the cap 35 at a relatively high level and prevents the ink from becoming dry in the nozzles 20*a* when the nozzle surface is sealed by the cap 35.

The suction pump 34, through which the suction tube 33 extends, is fixed to the frame 12 (see FIG. 2). The suction pump 34 includes a pump frame 36*a*, a pump wheel 36*b*, and rollers 36*e*, 36*f*. Roller support grooves 36*c*, 36*d* are defined in the pump wheel 36*b*. Each of the rollers 36*e*, 36*f* is movable along the corresponding one of the roller support grooves 36*c*, 36*d*. The suction tube 33 is wrapped around the pump wheel 36*b*. The pump frame 36*a* maintains the suction tube 33 in such a manner as to prevent the wrapped portion of the suction tube 33 from displacing radially outward. Each of the roller support grooves 36*c*, 36*d* extends in an arched manner from a radial inward position to a radial outward position.

Figure 7:
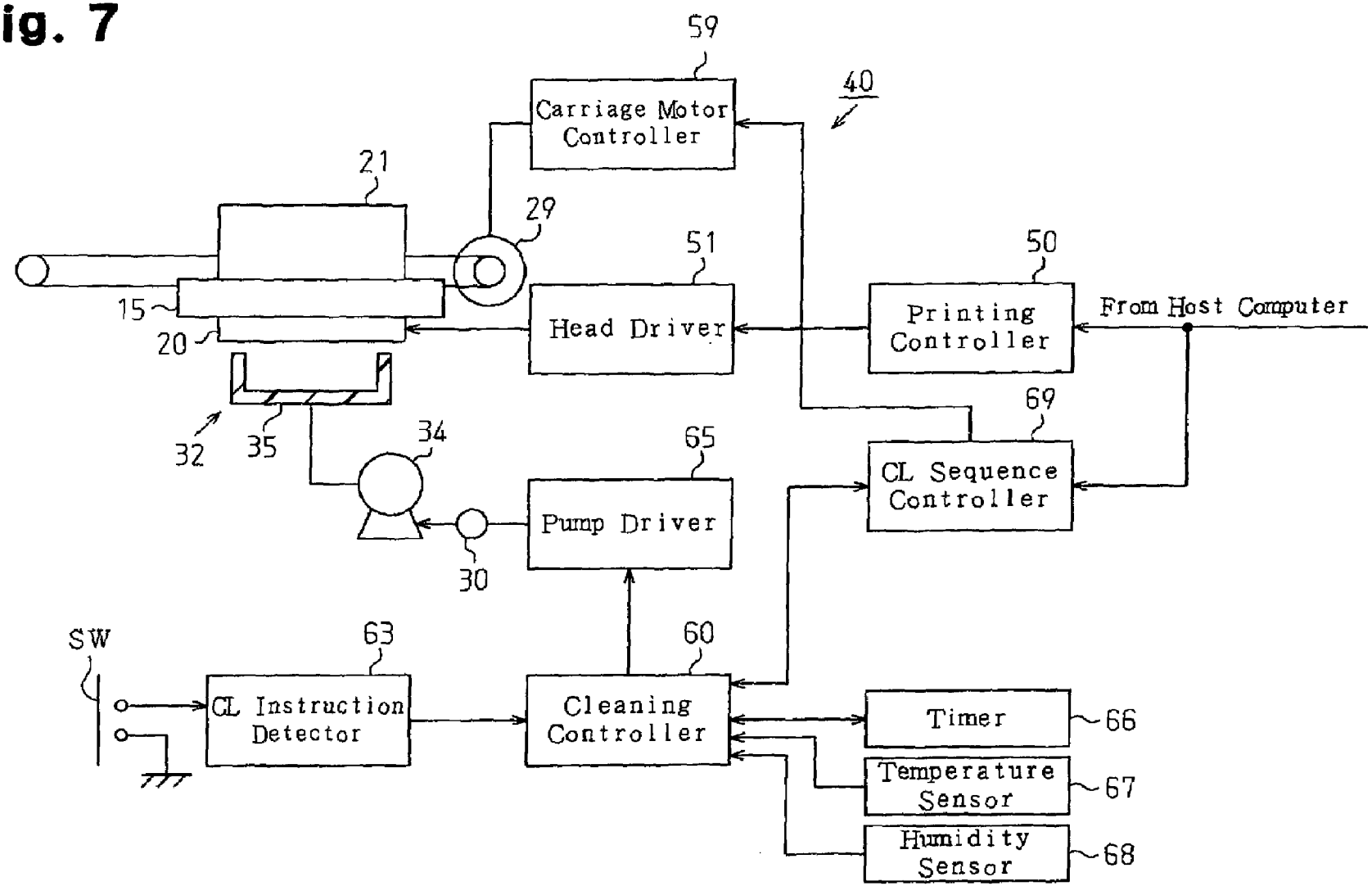
FIG. 7 is a block diagram representing a control circuit of the printer of FIG. 1.

The pump wheel 36*b* is rotated through actuation of a paper feeder motor 30 (see FIG. 7). If the pump wheel 36*b* is rotated in a forward direction (a clockwise direction in FIG. 4, hereinafter referred to as a pump suction direction), the rollers 36*e*, 36*f* move to radial outer ends in the corresponding roller support grooves 36*c*, 36*d*. The rollers 36*e*, 36*f* thus revolve while continuously squeezing the suction tube 33. This state of the suction pump 34 in which the suction tube 33 is being squeezed will hereafter be referred to as a "pump-engaged state".

Therefore, an upstream section of the suction tube 33 with respect to the suction pump 34 is depressurized when the suction pump 34 is operated. The air or the ink is thus gradually discharged from the interior of the cap 35, which maintains the nozzle surface in a sealed state, to the waste tank 25 through rotation of the pump wheel 36*b*. The pressure in the cap 35 is thus gradually lowered.

If the pump wheel 36*b* is rotated in a reverse direction (a counterclockwise direction in FIG. 4), the rollers 36*e*, 36*f* move to radial inner ends in the corresponding roller support grooves 36*c*, 36*d*. The suction pump 34 is thus switched to a released state in which the rollers 36*e*, 36*f* slightly contact the suction tube 33. In this state, the pressure in the suction pump 34 coincides with the atmospheric pressure.

Control Circuit 40

A control circuit 40 of the printer 11 will now be described referring to the block diagram of FIG. 7.

A printing controller 50 produces bit map data as liquid ejection data based on printing data provided by a host computer of the printer 11. In correspondence with the bit map data, the printing controller 50 produces a drive signal through a head driver 51 so as to permit ink ejection from the recording head 20.

A cleaning instruction switch SW is provided in a manipulation panel (not shown) of the printer 11. When the cleaning switch SW is turned on, an ON signal is input to a cleaning (CL) instruction detector 63. The CL instruction detector 63 then generates a cleaning command that is input to a cleaning controller 60, or control means. In response to the cleaning command, the cleaning controller 60 initiates cleaning. Specifically, a cleaning sequence controller 69 acquires a cleaning sequence program from the host computer (not shown). The cleaning sequence controller 69 then produces a sequence control signal and sends the signal to the cleaning controller 60. In response to the sequence control signal, the cleaning controller 60 operates the paper feeder motor 30 through a pump driver 65. In ether words, the cleaning controller 60 operates the suction pump 34 through the pump driver 65 and the paper feeder motor 30. The pump driver 65 defines a circuit for driving the paper feeder motor 30. The pump driver 65 thus produces a pulse signal and sends the signal to the paper feeder motor 30. In correspondence with the pulse signal, the paper feeder motor 30 is operated by a predetermined angle. Therefore, the suction pump 34 rotates at the rotation speed corresponding to the frequency of the pulse signal of the pump driver 65. Also, the total number of rotations of the suction pump 34 is variable in correspondence with the duration of the pulse signal of the pump driver 65, which is input to the paper feeder motor 30.

The cleaning sequence controller 69 also sends a control signal to a carriage motor controller 59. In correspondence with the control signal, the carriage motor controller 59 operates the carriage motor 29.

A timer 66 measures the elapsed time T1, which has elapsed since the previous cycle of cleaning (the time that has elapsed without cleaning). That is, the timer 66 measures the time from when a certain cycle of cleaning is completed to when a cleaning command for a subsequent cycle of cleaning is produced. A temperature sensor 67 is arranged in the waste tank 25 and detects the ambient temperature in the vicinity of the flushing liquid receiver section 37. The temperature sensor 67 then sends a corresponding detection signal to the cleaning controller 60. A humidity sensor 68 is provided in the waste tank 25 and detects the ambient humidity in the vicinity of the flushing liquid receiver section 37. The humidity sensor 68 then outputs a corresponding detection signal to the cleaning controller 60.

Figure 8:
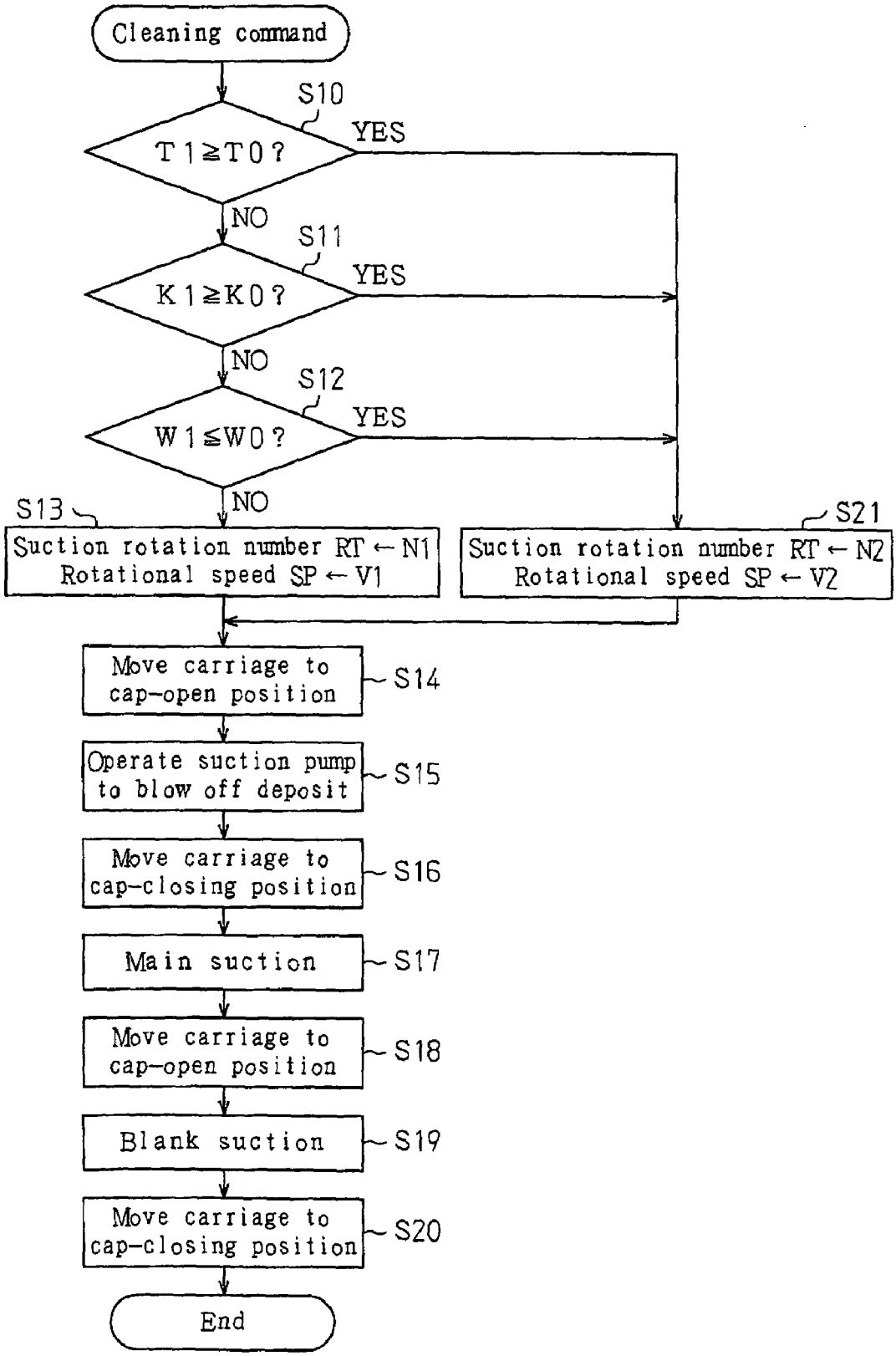
FIG. 8 is a flowchart representing a cleaning sequence according to the first embodiment.

A cleaning sequence performed on the recording head 20 of the printer 11, which is constructed as above-described, will hereafter be explained referring to the flowchart of FIG. 8.

The cleaning sequence is carried out by the cleaning sequence controller 69 in accordance with a control program that is stored in the cleaning sequence controller 69, which is shown in FIG. 7. When executing the sequence, the cleaning sequence controller 69 sends control signals to the cleaning controller 60 and the carriage motor controller 59. The cleaning controller 60 and the cleaning sequence controller 69 are capable of transmitting and receiving various data with respect to each other.

First, the cleaning instruction switch SW is turned on by the user of the printer 11. This causes the cleaning instruction detector 63 to provide the cleaning command to the cleaning controller 60.

Step S10

In step S10, in response to the cleaning command, the cleaning controller 60 determines whether the elapsed time T1 since the previous cycle of cleaning is greater than or equal to a reference time T0, in accordance with a current measurement of the timer 66. The reference time T0 has been stored in advance in the cleaning sequence controller 69.

If the elapsed time T1 is greater than or equal to the reference time T0 in step S10, or the determination of step S10 is "YES", the cleaning controller 60 executes step S21. If the elapsed time T1 is less than the reference time T0, or if the determination of step S10 is "NO", the cleaning controller 60 executes step S11.

The reference time T0 corresponds to the minimum time that elapses from when the waste ink is drained into the waste tank 25 to when a solid deposit of the waste ink is formed as measured under a normal temperature (for example, 20 degrees Celsius) and a humidity of 50 to 80 percent. The deposit of the waste ink is produced through evaporation of solvent of the ink, which increases the viscosity of the ink or dries the ink. The reference time T0 is obtained by tests. If the elapsed time T1 is greater than or equal to the reference time T0, it is likely that the solid deposit of the waste ink of the recording head 20 has already been formed in the waste tank 25. It is thus assumed that the waste ink has formed a deposit.

Step S11

The ambient temperature in the vicinity of the flushing liquid receiver section 37 detected by the temperature sensor 67 corresponds to a detected temperature K1. In step S11, the cleaning controller 60 determines whether the detected temperature K1 is greater than or equal to a reference temperature K0. At a temperature higher than or equal to the reference temperature K0, it is assumed that the waste ink easily solidifies or becomes more viscous. In this state, it is likely that a solid deposit of the waste ink has been formed in the waste tank 25. Thus, if it is determined that the detected temperature K1 is greater than or equal to the reference temperature K0, it is assumed that the waste ink has formed a deposit. The reference temperature K0 has been obtained by a test and stored in advance in the cleaning sequence controller 69. If it is determined that the detected temperature K1 is greater than or equal to the reference temperature K0, or if the determination of step S11 is "YES", the cleaning controller 60 executes step S21. If it is determined that the detected temperature K1 is less than the reference temperature K0, or if the determination of step S11 is "NO", the cleaning controller 60 carries out step S12.

Step S12

The ambient humidity in the vicinity of the flushing liquid receiver section 37 detected by the humidity sensor 68 corresponds to a detected humidity W1. In step S12, the cleaning controller 60 determines whether the detected humidity W1 is less than or equal to a reference humidity W0. It is assumed that the waste ink easily solidifies or becomes more viscous at a humidity lower than or equal to the reference humidity W0. In this state, it is likely that a solid deposit of the waste ink has been formed in the waste tank 25. Thus, if it is determined that the detected humidity W1 is less than or equal to the reference humidity W0, it is assumed that the waste ink has formed a deposit. The reference humidity W0 has been obtained by tests and stored in advance in the cleaning sequence controller 69. If it is determined that the detected humidity W1 is less than or equal to the reference humidity W0, or if the determination of step S12 is "YES", the cleaning controller 60 executes step S21. If it is determined that the detected humidity W1 is greater than the reference temperature W0, or if the determination of step S12 is "NO", the cleaning controller 60 carries out step S13.

The elapsed time T1 (the time without cleaning) of step S10, the ambient temperature of the flushing liquid receiver section 37 of step S1, the ambient humidity of the flushing liquid receiver section 37 of step S12 correspond to deposit promoting factors that promotes formation of a deposit of the waste ink. The timer 66, the temperature sensor 67, and the humidity sensor 68 correspond to detectors that detect the deposit promoting factors.

Step S13

In step S13, the suction rotation number RT, or the total number of rotations, and the rotation speed SP are set by the cleaning controller 60. Specifically, the suction rotation number RT is set to a predetermined value N1 and the rotation speed SP is set to a predetermined value V1. The values N1, V1 are stored in advance in the cleaning sequence controller 69 and retrieved if the determinations of steps S10 to S12 are all negative. Following step S13, the cleaning controller 60 executes step S14.

Step S21

If the determinations of any one of steps S10 to S12 is positive, the cleaning controller 60 sets the suction rotation number RT and the rotation speed SP in step S21. Specifically, the suction rotation number RT is set to a predetermined value N2 and the rotation speed SP is set to a predetermined value V2. The values N2, V2 are stored in advance in the cleaning sequence controller 69. Following step S21, the cleaning controller 60 executes step S14.

Regarding the suction rotation number RT, the value N1 is less than the value N2 (N1<N2). Regarding the rotation speed SP, the value V01 is less than the value V2 (V1<V2). In the first embodiment, for example, the value N1 corresponds to 3 and the value N2 corresponds to 9. The value V1 corresponds to 0.5 rps and the value V2 corresponds to 3 rps.

The positive determination in any one of steps S10 to S12 indicates a likeliness of deposit formation by the waste ink. Thus, in step S15, ink must be blown off in a short time at a high rotation speed. Thus, in step S21, the suction rotation number RT and the rotation speed SP are set to the values larger than the corresponding values of step S13. By operating the suction pump 34 at an increased rotation speed and for a shorter time, the time in which noise is generated by the suction pump 34 can be shortened.

Contrastingly, if the determinations of steps S10 to S12 are all negative, it is determined that the deposit formation by the waste ink has been unlikely. Therefore, in step S15, the time for blowing off the ink can be prolonged and the rotation speed can be decreased. Thus, in step S13, the suction rotation number RT and the rotation speed SP are set to the values less than the corresponding values of step S21. The suction pump 34 is thus operated at a decreased rotation speed, which suppresses noise generation by the suction pump 34.

Step S14

After steps S13 or S21, the cleaning sequence controller 69 operates the carriage motor controller 59 to generate a control signal in step S14. In response to the control signal, the carriage motor 29 operates to shift the recording head 20 to the cap-open position. In this manner, the cap 35 is separated from the recording head 20 and thus exposes the upstream portion of the suction pump 34 to the atmospheric air (the cap 35 is held in an open state).

Step S15

In step S15, the cleaning controller 60 operates the pump driver 65 to output a control signal to the paper feeder motor 30. This rotates the paper feeder motor 30, thus rotating the suction pump 34 in the pump suction direction at the rotation speed SP until the number of rotations is equal to the suction rotation number RT. In other words, in step S15, the suction pump 34 is driven to switch the rollers 36*e*, 36*f* to the pump-engaged state in which the flexible suction tube 33 is squeezed by the rollers 36*e*, 36*f*.

More specifically, if the rotation speed SP and the suction rotation number RT have been set to values V2, N2 in step S21, the suction pump 34 is rotated at 3 rps for nine complete rotations. Therefore, the suction pump 34 performs suction while rotating at a higher speed than the rotation speed SP of step S13, with the upstream portion of the suction pump 34 exposed to the atmospheric air. This causes a rapid blast of the air proceeding toward a deposit 100 of the waste ink (see FIG. 3), which is formed in the flushing liquid receiver section 37 of the waste tank 25, through the discharge port 33*a* of the suction tube 33, thus blowing off the deposit 100. The deposit 100 may have originated from the ink flushed from the recording head 20 into the waste tank 25 through the through hole 23*a* or the waste ink discharged from the discharge port 33*a* of the suction tube 33 into the waste tank 25. Formation of the deposit 100 involves evaporation of the solvent contained in the flushed ink or the waste ink, which increases the viscosity of the ink or solidifies the ink.

In this case, the suction pump 34 is operated in accordance with the suction rotation number RT (9 complete rotations) of step S21 that is greater than the suction rotation number RT of step S13. The corresponding actuation time is three seconds (N2/V2) and shorter than the actuation time of the case in which the setting values of step S13 are employed, or six seconds (N1/V1). If the suction pump 34 is operated at a higher rotation speed but for a shorter time, as in the case in which the setting values of step S21 are employed, the duration of the noise generation by the suction pump 34 can be shortened.

If the rotation speed SP and the suction rotation number RT have been set to values V1, N1 in step S13, the suction pump 34 is operated at 0.5 rps for three cycles. Therefore, the suction pump 34 performs suction at a lower speed than the rotation speed SP of step S21 with the upstream portion of the suction pump 34 exposed to the atmospheric air. This causes a rapid air blast proceeding toward the deposit 100 of the waste ink, which is formed in the flushing liquid receiver section 37 of the waste tank 25, through the discharge port 33*a* of the suction tube 33, thus blowing off the deposit 100.

In this case, the suction pump 34 is actuated for three complete rotations, which is less than the suction rotation number of step S21. The corresponding actuation time is six seconds (N1/V1) and longer than the actuation time of the case in which the setting values of step S21 are employed, or three seconds (N2/V2). If the suction pump 34 is operated at a lower rotation speed, as in the cases in which the setting values of step S13 are employed, the noise generation by the suction pump 34 is suppressed.

Step S16

Following step S15, step S16 is performed. Specifically, the cleaning sequence controller 69 operates the carriage motor controller 59 to generate a control signal. In response to the control signal, the carriage motor 29 operates to return the carriage motor 15 to the home position at which the corresponding position of the carriage 15 (the recording head 20) is defined as a cap-closing position. When the recording head 20 reaches the cap-closing position, the lift 70 raises the cap 35 and the cap 35 tightly contacts the recording head 20, thus sealing the openings of the nozzles 20*a* by the cap 35.

Step S17

In step S17, in response to an instruction of the cleaning controller 60, the pump driver 65 operates the paper feeder motor 30 to perform main cleaning. That is, the paper feeder motor 30 rotates the suction pump 34 in the pump suction direction. This generates negative pressure in the cap 35 and draws and drains the ink from the nozzles 20*a* of the recording head 20 into the cap 35. In the main cleaning, the suction pump 34 is operated at a relatively high rotation speed that is equal to the rotation speed SP of step S21. The total number of rotations of the suction pump 34 in the main cleaning is less than the suction rotation number RT of step S21 and greater than the suction rotation number RT of step S13. In the first embodiment, the total number of rotations of the main cleaning is set to five and the corresponding actuation time corresponds to 1.67 seconds (5 rotations/3 rps), which is shorter than the actuation time corresponding to the suction rotation number RT and the rotation speed SP of step S21. In other words, the main cleaning of step S17 is accomplished relatively quickly.

Step S18

In the subsequent step S18, the cleaning sequence controller 69 operates the carriage motor controller 59 to produce a control signal. In response to the control signal, the carriage motor 29 operates to move the recording head 20 to the cap-open position. This causes the lift 70 to lower the cap 35 and separate the cap 35 from the recording head 20. The openings of the nozzles 20*a* are thus released from the cap 35.

Step S19

In step S19, in response to an instruction of the cleaning controller 60, the pump driver 65 operates the paper feeder motor 30 to perform blank suction by rotating the suction pump 34 in the pump suction direction. This draws the ink from the cap 35 into the waste tank 25 and the discharge port 33*a* of the suction tube 33. In the blank suction, the suction pump 34 is operated at a relatively high rotation speed that is equal to the rotation speed SP of step S21. The total number of rotations of the suction pump 34 in the blank suction is greater than the suction rotation number RT of step S21. In the first embodiment, the total number of rotations of the blank suction is set to 15 and the actuation time corresponds to five seconds (15 rotations/3 rps).

Step S20

Subsequently, in step S20, the carriage motor controller 59 provides a control signal to the carriage motor 29, thus operating the carriage motor 29 to return the recording head 20 to the cap-closing position. The lift 70 then raises the cap 35 in such a manner that the cap 35 tightly contacts the recording head 20 and seals the openings of the nozzles 20*a*. The nozzle surface of the recording head 20 is thus sealed by the cap 35 and, in this state, the cleaning is ended.

In the first embodiment, if the time longer than or equal to the reference time T0 has elapsed after the previous cycle of cleaning, it is determined that a deposit of the waste ink has been formed in the waste tank 25.

Further, if the detected temperature K1 is higher than or equal to the reference temperature K0 or the detected humidity W1 is lower than or equal to the reference humidity W0, it is determined that the waste ink has been deposited.

In these cases, the suction pump 34 is operated for performing suction in a state exposed to the atmospheric air. The deposit 100 is then blown off by the air blasted from the discharge port 33*a* of the suction tube 33 to the deposit 100.

In the first embodiment, prior to the main suction of step S17, in which the ink is drawn from the nozzles 20*a*, step 15 is performed. That is, the deposit 100 is blown off by the air blast with the upstream portion of the suction pump 34 exposed to the atmospheric air. This saves the ink consumption of the printer 11. In other words, unlike conventional cases, the deposit 100 is blown off without using the ink from the recording head 20. This suppresses the ink consumed in maintenance of the printer 11 and thus saves costs. Further, since it is unnecessary to incorporate a specific device for blowing off the deposit 100, enlargement of the apparatus and complication of the configuration are avoided.

Figure 9:
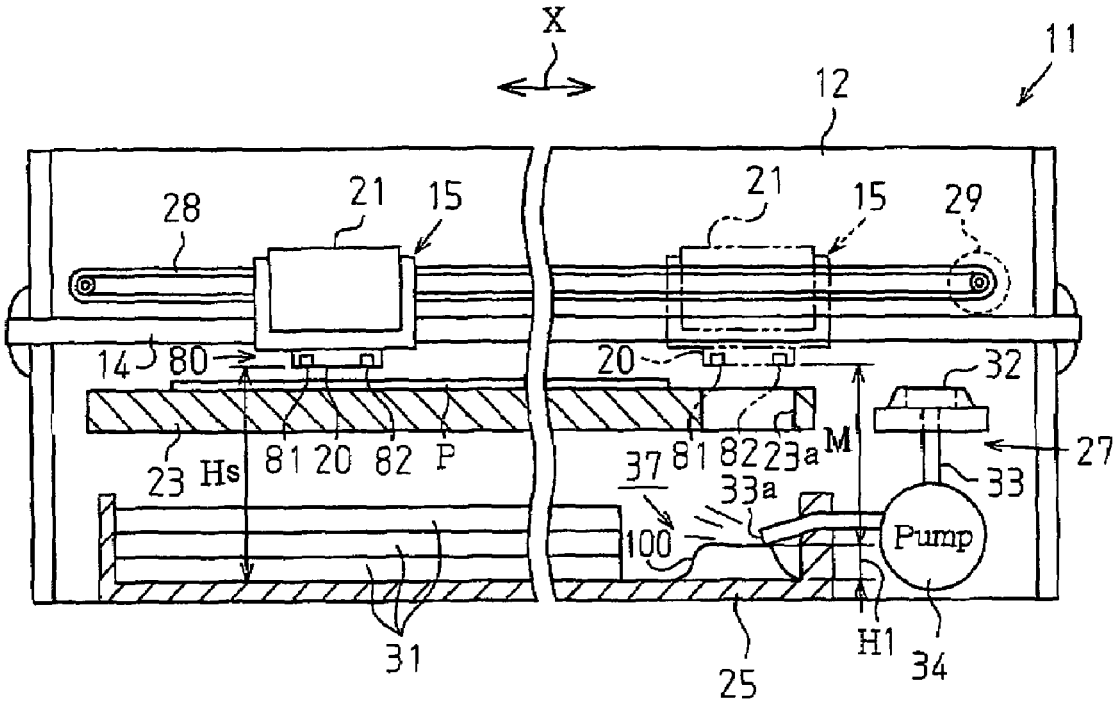
FIG. 9 is front cross-sectional view showing a printer according to a second embodiment of the present invention.
Figure 10:
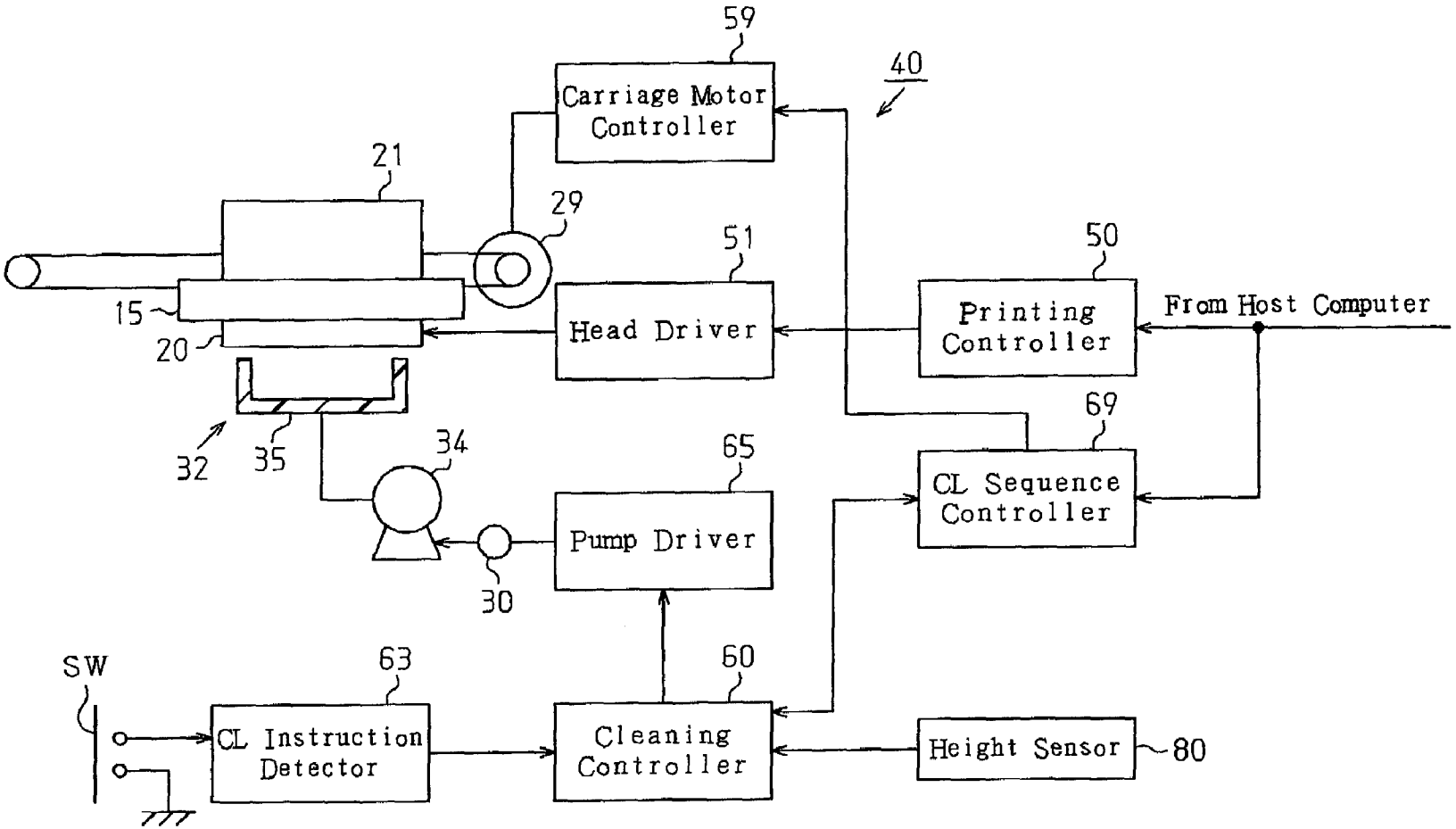
FIG. 10 is a block diagram showing the circuit configuration of the printer.

A second embodiment of the present invention will hereafter be described with reference to FIGS. 9 to 11. Same or like reference numerals are given to parts of the second embodiment that are the same as or like corresponding parts of the first embodiment and explanation of these parts will be omitted. The following description thus focuses on differences between the first embodiment and the second embodiment.

Unlike the first embodiment, the second embodiment does not include the timer 66, the temperature sensor 67, or the humidity sensor 68. Instead, as shown in FIG. 9, a height sensor 80, or a height detection device, is arranged at the nozzle surface of the recording head 20. The remainder of the second embodiment is configured identically to the corresponding parts of the first embodiment.

The height sensor 80 includes a light emitting portion 81 and a light receiving portion 82. When the recording head 20 is held at the cap-open position (indicated by the double-dotted broken lines in FIG. 9), the light receiving portion 82 receives the light emitted by the light emitting portion 81. The height sensor 80 thus detects the distance M from the distal end of the height sensor 80 to the peak of the deposit 100. In correspondence with the detected distance M, the height sensor 80 generates a signal representing a height H1 (H1=Hs−M) of the deposit 100. The signal is then provided to the cleaning controller 60, as illustrated in FIG. 10. The height H1 of the deposit 100 corresponds to the height of the deposit 100 that is measured from the inner bottom of the waste tank 25 to the peak of the deposit 100. The height H1 is determined by subtracting the distance M from the distance Hs from the inner bottom of the waste tank 25 to the height sensor 80.

Figure 11:
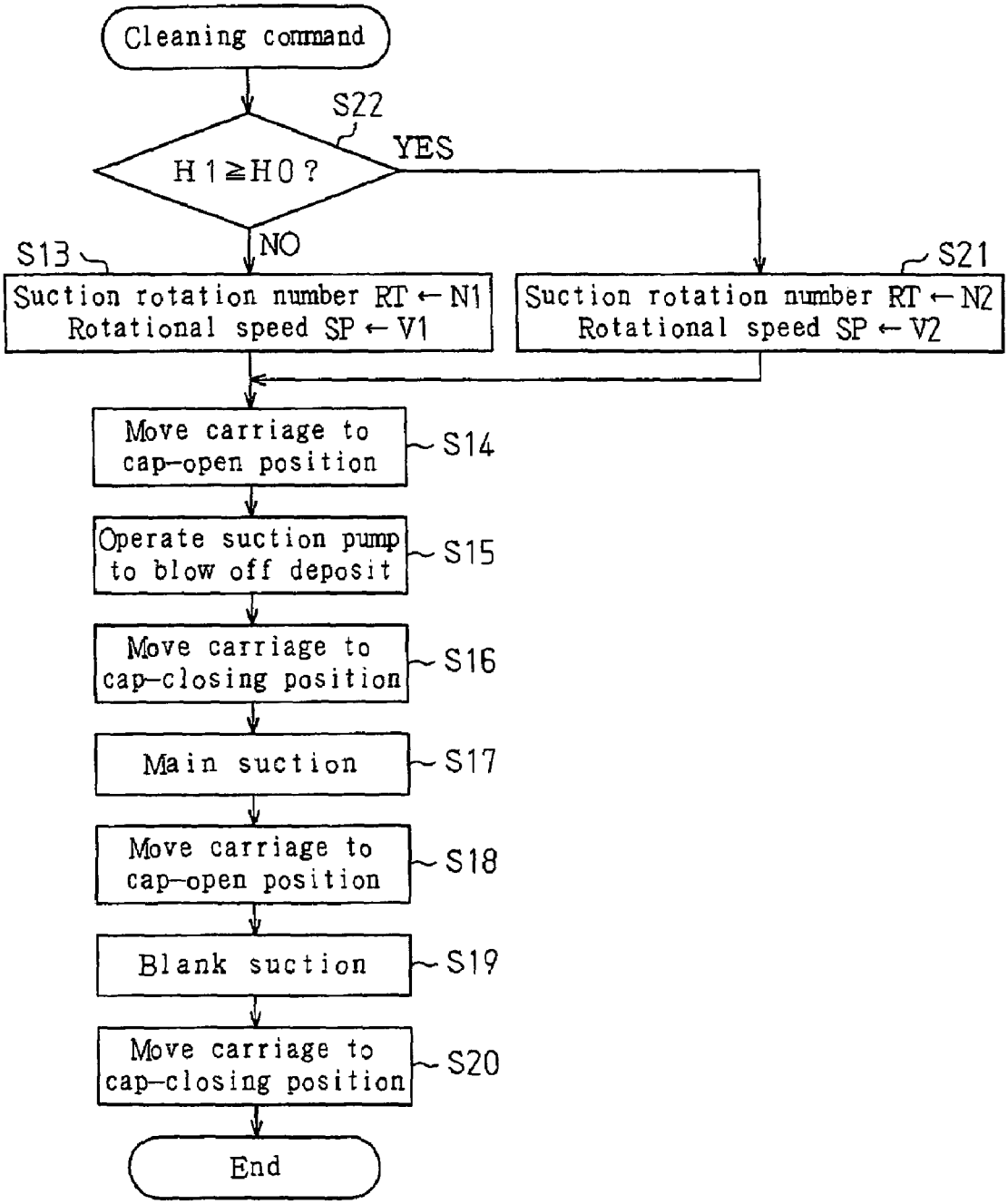
FIG. 11 is a flowchart representing a cleaning sequence according to the second embodiment.

FIG. 11 is a flowchart representing a cleaning sequence performed on the recording head 20 by the printer 11 of the second embodiment. The cleaning sequence of the second embodiment is different from that of the first embodiment of FIG. 8 in that steps S10 to S12 are replaced by step S22.

In step S22, the controller 60 determines whether the height H1 of the deposit 100, which has been provided by the height sensor 80, is greater than or equal to a reference height H0.

If the height H1 of the deposit 100 is not less than the reference height H0, it is assumed that the deposit 100 of the waste ink blocks the discharge port 33*a*. The reference height H0 is stored in advance in the cleaning sequence controller 69. If it is determined that the height H1 is greater than or equal to the reference height H0 in step S22, or if the determination is "YES", the cleaning controller 60 carries out step S21. If it is determined that the height H1 is less than the reference height H0 in step S22, or if the determination is "NO", the cleaning controller 60 performs step S13.

The other steps of the cleaning sequence according to the second embodiment are equivalent to the corresponding steps of the cleaning sequence according to the first embodiment of FIG. 8. Explanation thereof thus will be omitted.

In the second embodiment, the rotation speed and the total number of rotations of the suction pump 34 are varied in correspondence with the height H1 of the deposit 100, or the degree of deposit formation by the waste ink. Thus, if the height H1 is more than or equal to the reference height H0, the suction pump 34 is operated at a relatively high speed and for a relatively short time. If the height H1 is less than the reference height H0, the suction pump 34 is operated at a relatively low speed, thus suppressing noise generation.

Figure 12:
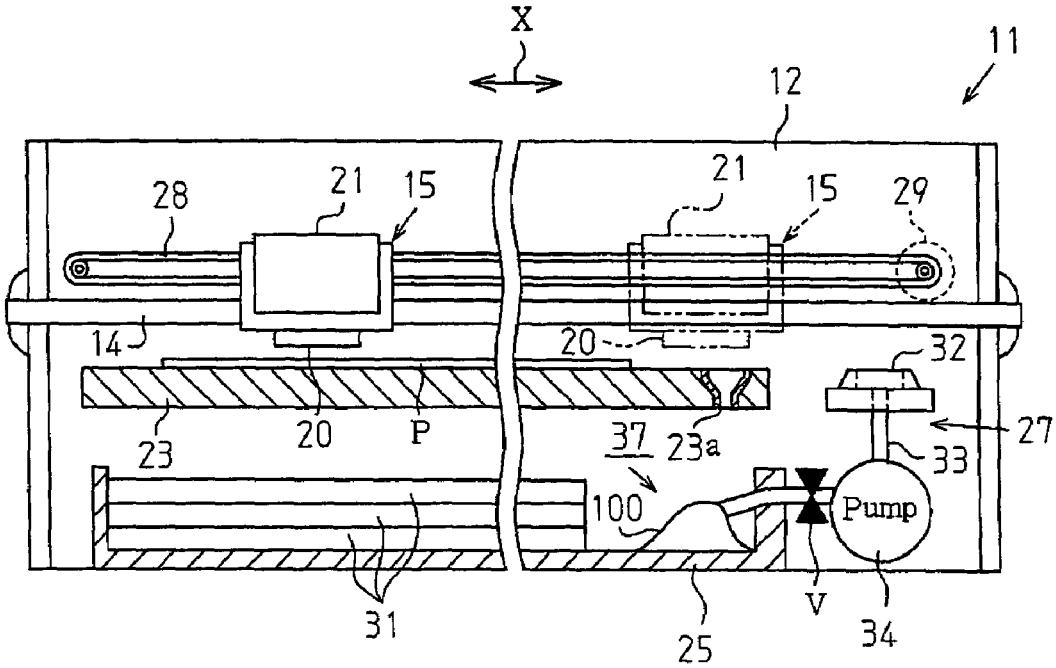
FIG. 12 is a front cross-sectional view showing a printer according to a third embodiment of the present invention.

Next, a third embodiment of the present invention will be explained with reference to FIG. 12. Same or like reference numerals are given to parts of the third embodiment that are the same as or like corresponding parts of the first embodiment and explanation of these parts will be omitted. The following description thus focuses on differences between the first embodiment and the third embodiment.

In the third embodiment, a valve V is provided at a position in the suction tube 33 (a gas passage) downstream from the suction pump 34 and selectively opened and closed by the cleaning controller 60. The valve V is closed when the suction pump 34 starts to rotate to blow off the deposit 100 with the recording head 20 held at the cap-open position. The valve V is opened after the suction pump 34 has operated for a predetermined number of rotations.

Therefore, cleaning sequence performed on the recording head 20 by the printer 11 according to the third embodiment is configured basically equivalent to that of the first embodiment, which is represented by the flowchart of FIG. 8. However, unlike the first embodiment, step S15 of the third embodiment includes controlling of operation of the valve V. Specifically, step S15 is executed in the following manner in the third embodiment.

In step S15, the cleaning controller 60 closes the valve V before operating the pump driver 65. The pump driver 65 is then operated to drive the paper feeder motor 30 in such a manner as to rotate the suction pump 34 in the pump suction direction at the rotation speed SP of steps S13 or S21. For such operation of the suction pump 34, the number of rotations is set to a value obtained by adding a predetermined value (for example, a value equal to the suction rotation number RT) to the suction rotation number RT that has been set in steps S13 or S21.

This increases the air pressure in an upstream section of the suction tube 33 with respect to the valve V. Therefore, in response to such increase of the air pressure, the cleaning controller 60 opens the valve V immediately after the number of rotations of the suction pump 34 has reached the predetermined value. The suction pump 34 is continuously operated until the number of rotations is equal to the suction rotation number RT. Thus, in response to opening of the valve V, the air under the increased pressure rapidly flows downstream in the suction tube 33. The air is then blasted from the discharge port 33*a* of the suction tube 33, effectively blowing off the deposit 100.

As has been described, in the third embodiment, rotation of the suction pump 34 is started while holding the valve V, which is provided downstream from the suction pump 34, in a closed state. The valve V is opened after sufficiently raising the air pressure in the upstream section of the suction tube 33 with respect to the valve V. This causes a rapid blast of the pressurized air flowing through the discharge port 33*a* of the suction tube 33. The deposit 100 is thus effectively blown off.

Figure 13:
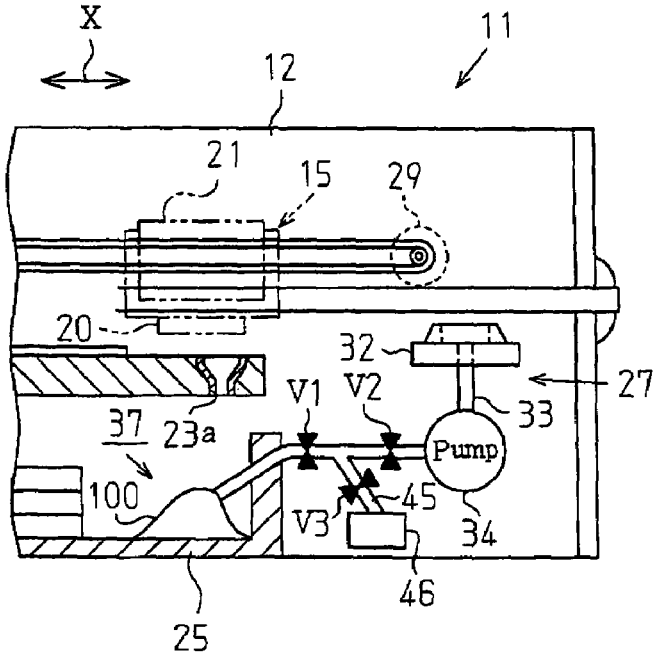
FIG. 13 is a front cross-sectional view showing a portion of a printer according to a fourth embodiment of the present invention.

A fourth embodiment of the present invention will hereafter be described with reference to FIG. 13. Same or like reference numerals are given to parts of the fourth embodiment that are the same as or like corresponding parts of the first embodiment and explanation of these parts will be omitted. The following description thus focuses on differences between the first embodiment and the fourth embodiment.

In the fourth embodiment, a first valve V1 and a second valve V2 are provided at positions in the suction tube 33 (the gas passage) downstream from the suction pump 34 and selectively opened and closed by the cleaning controller 60. The first valve V1 is arranged downstream from the second valve V2. A branch tube (a branch passage) 45 extends from a section of the suction tube 33 extending between the first and second valves V1, V2. A pressure chamber 46 communicates with the suction tube 33 through the branch tube 45. A third valve V3 is provided in the branch tube 45 and selectively opened and closed by the cleaning controller 60.

The suction pump 34 is operated with the recording head 20 held at the cap-open position in order to blow off the deposit 100. At an initial stage of such rotation, the first valve V1 is closed and the second and third valves V2, V3 are open. After rotating the suction pump 34 for a predetermined number of rotations, the second valve V2 is closed and the first valve V1 is opened. The third valve V3 is maintained in an open state.

In the fourth embodiment, a cleaning sequence performed on the recording head 20 by the printer 11 is configured basically equivalent to that of the first embodiment of FIG. 8. However, unlike the first embodiment, step S15 of the fourth embodiment includes controlling of operation of the first to third valves V1 to V3. Specifically; step S15 is executed in the following manner in the fourth embodiment.

In step S15, prior to operation of the pump driver 65, the cleaning controller 60 operates each of the first to third valves V1 to V3. Specifically, at this stage, the first valve V1 is closed and the second and third valves V2, V3 are open. In this state, the pump driver 65 is activated to rotate the paper feeder motor 30. The suction pump 34 is thus rotated in the pump suction direction at the rotation speed SP that has been set in steps S13 or S21. For such rotation of the suction pump 34, the number of rotations of the suction pump 34 is set to a value obtained by adding a predetermined value (for example, a value equal to the suction rotation number RT) to the suction rotation number RT that has been set in steps S13 or S21.

This introduces the air from the suction tube 33 into the pressure chamber 46 via the branch tube 45. The pressure of the air thus accumulates and increases in the pressure chamber 46. In response to such increase of the air pressure in the pressure chamber 46, the cleaning controller 60 closes the second valve V2 and opens the first valve V1 while maintaining the third valve V3 in an open state immediately after the number of rotations of the suction pump 34 has reached the set value (the suction rotation number RT+ the predetermined value). As a result, in response to opening of the first valve V1, a rapid flow of the pressurized air from the pressure chamber 46 starts to proceed downstream in the suction tube 33 through the branch tube 45. The air is thus blasted from the discharge port 33*a* of the suction tube 33, effectively blowing off the deposit 100.

As has been described, in the fourth embodiment, by selectively operating the valves V1, V2, V3, the air is accumulated and pressurized in the pressure chamber 46, which is provided downstream from the suction pump 34. The pressurized air is then blasted rapidly from the discharge port 33*a* of the suction tube 33. This effectively blows off the deposit 100 in the waste tank 25. Since the second valve V2 is closed in this state, ink suction from the nozzles 20*a* of the recording head 20 does not occur even with the nozzle surface of the recording head 20 sealed. In order to discharge the waste ink into the waste tank 25 through the discharge port 33*a* without blowing off the deposit 100, the suction pump 34 is activated with the third valve V3 closed and the first and second valves V1, V2 open.

Figure 14:
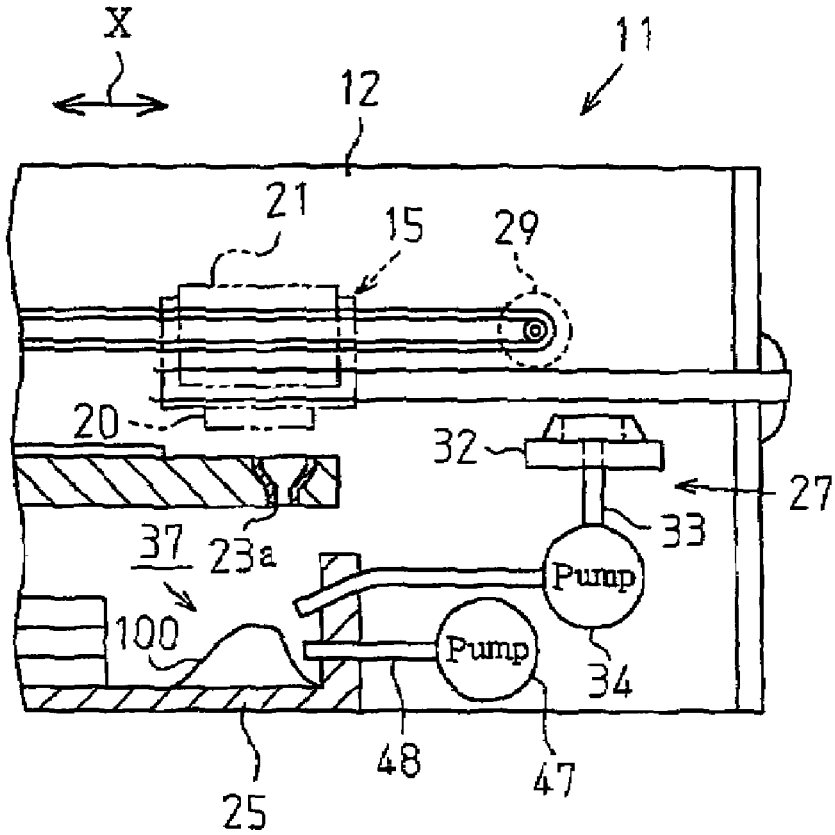
FIG. 14 is a cross-sectional view showing a portion of a printer according to a fifth embodiment of the present invention.

Next, a fifth embodiment of the present invention will be described with reference to FIG. 14. Same or like reference numerals are given to parts of the fifth embodiment that are the same as or like corresponding parts of the first embodiment and explanation of these parts will be omitted. The following description thus focuses on differences between the first embodiment and the fifth embodiment.

In the fifth embodiment, in addition to the suction pump 34, an air pump 47 is arranged in a lower section in the frame 12 and operated by the cleaning controller 60. The air pump 47 is operated exclusively for blasting the air. An air blasting tube 48 extending from the air pump 47 is introduced into the waste tank 25. When the air pump 47 runs, the pressurized air is blasted through the air blasting tube 48 and effectively blows off the deposit 100 in the waste tank 25. Further, although not illustrated, the height sensor 80 (see FIG. 9) of the second embodiment is arranged in the recording head 20 of the fifth embodiment.

When the height H1 of the deposit 100, which has been detected by the height sensor 80, becomes greater than or equal to the reference height H0, the cleaning controller 60 activates the air pump 47, thus blowing off the deposit 100. That is, the deposit 100 is blown off by activating the air pump 47 as needed, regardless of the operational state of the suction pump 34.

The present invention is not restricted to the illustrated embodiments but may be modified as follows.

In the flowchart of FIG. 8, at least one of the three steps S10, S11, S12 may be saved while omitting the remaining step(s).

In each of the first to fifth embodiments, the deposit 100 is blown off by the air blasted through the suction pump 34 or the air pump 47. However, the air may be blasted by any suitable gas blasting device other than the suction pump 34 or the air pump 47. For example, a gas tank that retains pressurized gas (air) may be arranged in the frame 12. The deposit 100 is thus blown off by the pressurized gas blasted from the gas tank. In this case, the pressure of the gas blasted from the gas tank can be increased to a level higher than the pressure of the air blasted by the suction pump 34 or the air pump 47. Alternatively, the gas tank may be configured in the same manner as the ink cartridge 21, which is arranged in the carriage 15. The ink cartridge 21 is replaced by the gas tank when blowing off the deposit 100.

In the fifth embodiment, the air pump 47 may be a pump (for example, a syringe pump) that is manually operated by the user. In this case, when the height H1 of the deposit 100 detected by the height sensor 80 becomes greater than or equal to the reference height H0, the user is so informed, thus allowing the user to manually operate the pump.

If the printer 11 is an off-carriage type, the ink cartridge 21 is installed at a position separate from the carriage 15. A pressurization pump supplies pressurized air to the ink cartridge 21, thus sending ink from the ink cartridge 21 to the recording head 20 through an ink supply tube. In this case, the pressurization pump may function also as a gas blasting device.

In the main suction of step S17 of FIGS. 8 and 11, the rotation speed of the suction pump 34 in the main suction of step S17 is equal to the rotation speed SP of step S21. However, the rotation speed SP of step S17 may be different from the rotation speed SP of step S21. For example, the rotation speed SP of the main suction in step S17 may be set to a value lower than the rotation speed SP of step S21. In other words, the rotation speed SP of step S21 may be set to a value higher than the rotation speed of the main suction of step S17.

In this case, when blowing off the deposit 100, the suction pump 34 is operated at a higher speed than the rotation speed of the suction pump 34 when performing the nozzle cleaning (the main suction). The deposit 100 is thus blown off efficiently.

In the first embodiment, the height sensor 80 of the second embodiment may be additionally provided. In this case, step S22 of the flowchart of FIG. 11 is performed before step S10, between steps S10 and S11, between steps S11 and S12, or between steps S12 and S13 in the flowchart of FIG. 8.

In the third embodiment, with the valve V held in a closed state, the suction pump 34 is operated for a prolonged time corresponding to the predetermined number of rotations.

This delays the timing for starting the main suction. To solve this problem, in step S15, the valve V may be operated selectively in correspondence with the degree of formation of the deposit 100. More specifically, if the rotation speed SP and the suction rotation number RT of the suction pump 34 have been set in step S13, the valve V is maintained in an open state in step S15. The valve V is closed if it is assumed likely that the deposit 100 has been formed, or if the rotation speed SP and the suction rotation number RT of the suction pump 34 have been set in step S21. Further, the height sensor 80 of the second embodiment may be additionally provided in the third embodiment. In this case, the valve V is closed in step S15 if the height H1 of the deposit 100 detected by the height sensor 80 is greater than or equal to the reference height H0.

In the third embodiment, to increase the air pressure in the upstream section of the suction tube 33 with respect to the valve V, the suction pump 34 is operated in accordance with the number of rotations that is equal to the suction rotation number RT, which is set in steps S13 or S21. However, such number of rotations is not restricted to this value but may be modified to any suitable value as long as the deposit 100 can be effectively blown off by the pressure caused by the air blast.

In each of the illustrated embodiments, the present invention is applied to the liquid ejection apparatus defined by the printer 11 (which may be, for example, a fax machine or a copier). The printer 11 ejects ink, or liquid, onto the paper sheet P serving as the target through the recording head 20, or the liquid ejection head. However, the present invention may be applied to any suitable liquid ejection apparatuses that eject other types of liquid than ink. Such ejection apparatuses include those that eject electrode material or color material for manufacturing liquid crystal displays, EL displays, or area light emitting displays, or those that eject biological organic matter for manufacturing biochips, or sample ejection apparatuses serving as precision pipettes.

The present examples and embodiments are to be considered as illustrative and not restrictive and the invention is not to be limited to the details given herein, but may be modified within the scope and equivalence of the appended claims.

The invention claimed is:

1. A method for cleaning a liquid ejection apparatus, the apparatus including a liquid ejection head that has a nozzle through which a liquid is ejected onto a target and a waste tank that retains the liquid discharged from the liquid ejection head as a waste liquid, a deposit of the waste liquid being formed in the waste tank, the method comprising:

blowing off the deposit by blasting gas to the deposit in the waste tank through actuation of a gas blasting device.

2. A method for cleaning a liquid ejection apparatus, the apparatus including a liquid ejection head that has a nozzle through which a liquid is ejected onto a target and a waste tank that retains the liquid discharged from the liquid ejection head as a waste liquid, a deposit of the waste liquid being formed in the waste tank, the method comprising:

blowing off the deposit by blasting gas to the deposit in the waste tank through actuation of a gas blasting device, wherein the gas blasting device includes a pump that draws gas from an upstream side and sends the gas to a downstream side, and wherein the blowing off the deposit comprises:

actuating the pump to draw the gas with the downstream side of the pump held in a closed state; and opening the downstream side of the pump to blast the gas to the deposit when the pressure of the drawn gas is increased.

3. A liquid ejection apparatus comprising:

a liquid ejection head having a nozzle through which a liquid is ejected onto a target;

a waste tank in which the liquid is retained as a waste liquid after having been discharged from the liquid ejection head, a deposit of the waste liquid being formed in the waste tank; and a gas blasting device that blows off the deposit by blasting gas to the deposit in the waste tank.

4. A liquid ejection apparatus comprising:

a liquid ejection head having a nozzle through which a liquid is ejected onto a target;

a waste tank in which the liquid is retained as a waste liquid after having been discharged from the liquid ejection head, a deposit of the waste liquid being formed in the waste tank; and a gas blasting device that blows off the deposit by blasting gas to the deposit in the waste tank;

wherein the gas blasting device includes a suction pump used in a nozzle cleaning performed by forcibly drawing and draining the liquid from the nozzle, the suction pump being activated to blast the gas to the deposit with an upstream side of the pump exposed to the atmospheric air.

5. The apparatus according to claim 4, wherein the suction pump is operated at a higher speed when blasting the gas to the deposit than when performing the nozzle cleaning.

6. The apparatus according to claim 4, wherein the suction pump is operated by a greater number of rotations when blasting the gas to the deposit than when performing the nozzle cleaning.

7. The apparatus according to claim 4, further comprising:

a cap connected to the upstream side of the suction pump, wherein the cap is switched between a sealing state in which the cap seals a portion of the liquid ejection head that defines an opening of the nozzle and an open state in which the cap holds the upstream side of the suction pump in a state exposed to the atmospheric air, the cap being switched to the sealing state when performing the nozzle cleaning; and a controller that controls the suction pump, wherein, when performing the nozzle cleaning, the controller starts the suction pump with the cap held in the open state before the cap is switched to the sealing state.

8. The apparatus according to claim 7, wherein the controller sets an actuation speed of the suction pump when the cap is held in the open state to a value greater than the actuation speed of the suction pump when the cap is held in the sealing state.

9. The apparatus according to claim 7, wherein the controller changes at least one of an actuation speed and a total number of rotations of the suction pump in correspondence with a magnitude of a deposit promoting factor that promotes formation of the deposit in the waste tank or a level of such deposit formation.

10. The apparatus according to claim 9 further comprising a detector that detects the magnitude of the deposit promoting factor or the level of the deposit formation, wherein the controller operates the suction pump in accordance with a detection result of the detector.

11. The apparatus according to claim 10, wherein the deposit promoting factor includes a time that has elapsed after a previous cycle of the nozzle cleaning, and wherein the detector includes a timer for measuring the elapsed time.

12. The apparatus according to claim 10, wherein the deposit promoting factor includes an ambient temperature in a vicinity of the deposit, and wherein the detector includes a temperature sensor that detects the ambient temperature.

13. The apparatus according to claim 10, wherein the deposit promoting factor includes an ambient humidity in a vicinity of the deposit, and wherein the detector includes a humidity sensor that detects the ambient humidity.

14. The apparatus according to claim 10, wherein the level of the deposit formation includes a height of the deposit, and wherein the detector includes a height sensor that detects the height of the deposit.

15. A liquid ejection apparatus comprising:

a liquid ejection head having a nozzle through which a liquid is ejected onto a target;

a waste tank in which the liquid is retained as a waste liquid after having been discharged from the liquid ejection head, a deposit of the waste liquid being formed in the waste tank; and a gas blasting device that blows off the deposit by blasting gas to the deposit in the waste tank;

a gas passage that guides a gas from the gas blasting device to the waste tank;

a valve provided in the gas passage; and a controller that controls the gas blasting device and the valve, wherein the controller starts operation of the gas blasting device with the valve held in a closed state, and then opens the valve to blast the gas to the deposit when the pressure of the gas in an upstream section of the gas passage from the valve is increased.

16. A liquid ejection apparatus comprising:

a liquid ejection head having a nozzle through which a liquid is ejected onto a target;

a waste tank in which the liquid is retained as a waste liquid after having been discharged from the liquid ejection head, a deposit of the waste liquid being formed in the waste tank; and a gas blasting device that blows off the deposit by blasting gas to the deposit in the waste tank;

a gas passage that guides a gas from the gas blasting device to the waste tank;

a first valve and a second valve provided in the gas passage, the first valve being arranged downstream from the second valve;

a pressure chamber that communicates with a section of the gas passage between the first and second valves;

a third valve that selectively permits and blocks communication between the pressure chamber and the gas passage; and a controller that controls the gas blasting device and the first to third valves, wherein the controller starts operation of the gas blasting device with the first valve held in a closed state and the second and third valves held in an open state, and then closes the second valve and opens the first valve while maintaining the third valve in the open state to blast the gas to the deposit when the pressure of the gas in the pressure chamber is increased.

17. The apparatus according to claim 3 further comprising a suction pump used for forcibly drawing and draining the liquid from the nozzle, wherein the gas blasting device is provided independently from the suction pump.

* * * * *